US009823614B2

(12) United States Patent
Ogawa et al.

(10) Patent No.: US 9,823,614 B2
(45) Date of Patent: Nov. 21, 2017

(54) PHOTORECEPTOR DRUM HAVING A FLANGE

(71) Applicant: FUJI ELECTRIC CO., LTD., Kanagawa (JP)

(72) Inventors: Yuji Ogawa, Matsumoto (JP); Keiichi Kurokawa, Matsumoto (JP)

(73) Assignee: FUJI ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 15/256,625

(22) Filed: Sep. 5, 2016

(65) Prior Publication Data

US 2017/0299998 A1 Oct. 19, 2017

(30) Foreign Application Priority Data

Apr. 18, 2016 (JP) ..... 2016-082993

(51) Int. Cl.
*G03G 15/00* (2006.01)

(52) U.S. Cl.
CPC ..... *G03G 15/751* (2013.01)

(58) Field of Classification Search
CPC ..... G03G 15/751; G03G 21/1647; G03G 21/1671; G03G 2221/1657
USPC ..... 399/117
See application file for complete search history.

(56) References Cited

U.S. PATENT DOCUMENTS 5,436,699 A * 7/1995 Komaki ..... G03G 15/757 399/159
2004/0005169 A1* 1/2004 Yokomori ..... G03G 15/757 399/117
2005/0117934 A1 6/2005 Murayama et al.
2016/0033931 A1* 2/2016 Hasegawa ..... G03G 15/757 399/117

FOREIGN PATENT DOCUMENTS

JP 3193612 U 9/2014

* cited by examiner

*Primary Examiner* — Billy Lactaoen

(57) ABSTRACT

To reduce the influence of a coupling pin that fixes a shaft to a photoreceptor drum on rotation of a photoreceptor drum. To provide photoreceptor device including: a photoreceptor drum having an insertion hole formed along a lengthwise direction; and a flange that is provided at a lengthwise end portion of the photoreceptor drum and has a through hole formed thereon at a position to overlap the insertion hole, wherein the flange has a first protruding portion and a second protruding portion that: are provided on an end surface at which the through hole is provided and around the through hole; and protrude from the end surface, the first protruding portion has a first opening at a position facing the through hole, and the second protruding portion is provided at a position opposite to the first opening across a center of the through hole on the end surface.

10 Claims, 9 Drawing Sheets

20

20

20

20

20

20

PHOTORECEPTOR DRUM HAVING A FLANGE

The contents of the following Japanese patent application are incorporated herein by reference:

NO. 2016-082993 filed on Apr. 18, 2016.

BACKGROUND

1. Technical Field

The present invention relates to a photoreceptor device.

2. Related Art

Electrophotographic devices that use a photoreceptor drum are known. The photoreceptor drum has an insertion hole into which a shaft is inserted along the lengthwise direction of the photoreceptor drum. The shaft is fixed, by a pin or the like, with a flange provided at an end portion of the photoreceptor drum (see for example Patent Documents 1 and 2). Thereby, the photoreceptor drum rotates according to rotation of the shaft.

Patent Document 1: Japanese Patent No. 3782807

Patent Document 2: Japanese Utility Model Registration No. 3193612

Along with rotation of the photoreceptor drum, the pin for fixation also rotates. If the pin for fixation protrudes excessively from the shaft, the pin interferes with other members at the time of rotation of the photoreceptor drum, and rotation of the photoreceptor drum may be affected in some cases.

SUMMARY

A first aspect of the present invention provides a photoreceptor device comprising a photoreceptor drum and a flange. The photoreceptor drum may have an insertion hole formed along a lengthwise direction. The photoreceptor drum may have a tubular shape. The flange may be provided at a lengthwise end portion of the photoreceptor drum. The flange may have a through hole formed thereon at a position to overlap the insertion hole of the photoreceptor drum. The flange may have a first protruding portion that: is provided on an end surface at which the through hole is provided and around the through hole; and protrudes from the end surface. The first protruding portion may have a first opening at a position facing the through hole. The flange may have a second protruding portion that: is provided on an end surface at which the through hole is provided and around the through hole; and protrudes from the end surface. The second protruding portion may be provided at a position opposite to the first opening across a center of the through hole on the end surface.

A distance on the end surface of the flange between the second protruding portion and the through hole may be longer than a distance between the first protruding portion and the through hole. The first protruding portion may have a second opening that is located at a position opposite to the first opening across the center of the through hole on the end surface of the flange, and that has an opening width on the end surface of the flange which is larger than that of the first opening.

The second opening may have a contact surface that is located at part of an inner wall protruding from the end surface of the flange and that contacts a rod-like coupling pin when the coupling pin is inserted into the first opening and the second opening. A surface of the inner wall of the second opening that is opposite to the contact surface may not contact the coupling pin.

When performing printing operation, the photoreceptor drum may rotate in a predetermined rotational direction. The contact surface of the second opening may be provided downstream of the coupling pin in the rotational direction.

The second protruding portion may have an arc shape on a surface that is parallel with the end surface of the flange. A curvature of the second protruding portion may be larger than a curvature of the first protruding portion.

A thickness of the second protruding portion may be smaller than a length of the second protruding portion. The first protruding portion and the second protruding portion may be formed integrally.

A width of the second protruding portion may be larger than a width of the first opening on the end surface. The first opening may be provided with a tapered portion at an end portion thereof which is opposite to the through hole.

The summary clause does not necessarily describe all necessary features of the embodiments of the present invention. The present invention may also be a sub-combination of the features described above.

DESCRIPTION OF EXEMPLARY EMBODIMENTS

Hereinafter, (some) embodiment(s) of the present invention will be described. The embodiment(s) do(es) not limit the invention according to the claims, and all the combinations of the features described in the embodiment(s) are not necessarily essential to means provided by aspects of the invention.

Figure 1:
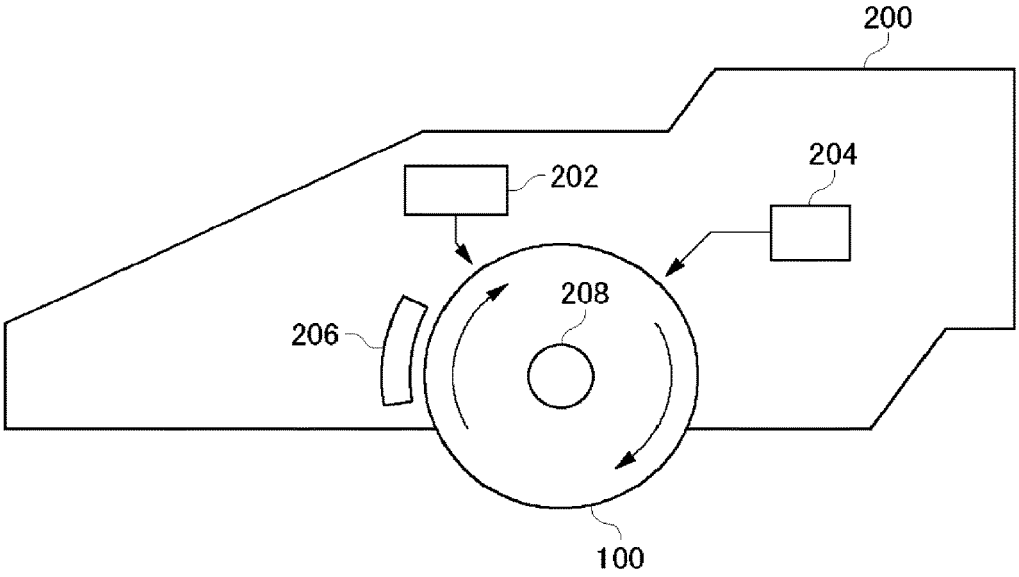
FIG. 1 is a cross-sectional view showing a summary of a print cartridge 200 to be incorporated in an electrophotographic device.

FIG. 1 is a cross-sectional view showing a summary of a print cartridge 200 to be incorporated in an electrophotographic device. A photoreceptor device 100, a charging control unit 202, a toner supply unit 204, a toner eliminating unit 206 and a shaft 208 are provided inside the print cartridge 200.

At least part of the photoreceptor device 100 has a tubular shape such as a cylindrical shape. The shaft 208 is inserted into the photoreceptor device 100. The shaft 208 and the photoreceptor device 100 are fixed by a pin or the like, and the photoreceptor device 100 can be rotated by rotating the shaft 208. A photoreceptor is provided on the front surface of the photoreceptor device 100.

The charging control unit 202 charges the front surface of the photoreceptor device 100 according to a pattern to be printed on an object such as paper. For example, the charging control unit 202 charges the front surface of the photoreceptor device 100 uniformly, and then forms, by exposure, a latent image according to a printing pattern.

The toner supply unit 204 attaches toner to a latent image formed by the charging control unit 202. A region to which the toner is attached faces the object such as paper by rotating the photoreceptor device 100. Then, the toner is transcribed onto the object such as paper. The toner eliminating unit 206 eliminates toner remaining on the photoreceptor device 100 after transcription. Such a step is repeated while rotating the photoreceptor device 100 so as to print a predetermined pattern on the object.

First Implementation Example

Figure 2:
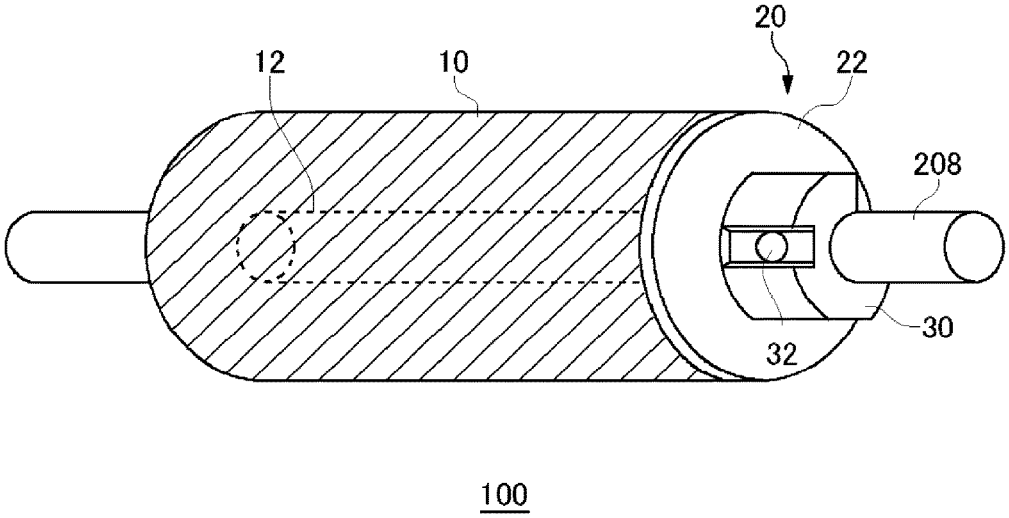
FIG. 2 is a perspective view showing a summary of a photoreceptor device 100 according to a first implementation example.

FIG. 2 is a perspective view showing a summary of the photoreceptor device 100 according to a first implementation example. FIG. 2 shows the photoreceptor device 100 in a state where the shaft 208 has penetrated therethrough. The photoreceptor device 100 comprises a photoreceptor drum 10 and a flange 20.

The photoreceptor drum 10 has a tubular shape such as a cylindrical shape. The photoreceptor drum 10 has a tubular insertion hole 12 formed along the lengthwise direction. The insertion hole 12 is preferably provided at the center of a cross-section of the photoreceptor drum 10 that is vertical to the lengthwise direction. FIG. 2 shows, with broken lines, the insertion hole 12 provided inside the photoreceptor drum 10. A photoreceptor is provided at the front surface of the photoreceptor drum 10. In FIG. 2, a region provided with a photoreceptor is shown with hatching.

In the photoreceptor drum 10 of the present example, a photoreceptive layer containing a photoconductive material is formed on an outer circumferential surface of a tubular conductive substrate. The conductive substrate may be formed of aluminum, an aluminum alloy or the like. Also, the conductive substrate may be formed by vapor-depositing an aluminum film on the front surface of a tubular plastic. As the photoconductive material, various types of a charge generating material such as phthalocyanine compounds or a charge transporting material such as hydrazone compounds can be used. Also, the photoreceptive layer may be formed by approaches such as immersion coating by dispersing or dissolving the above-mentioned materials into a binder together with other additives or the like. The photoreceptive layer may be either a laminate type comprising a charge generation layer and a charge transport layer or a single layer type formed by a single layer, and an under-coating layer may be provided between the conductive substrate and the photoreceptive layer. However, the materials of and methods of manufacturing each member of the photoreceptor drum 10 are not limited thereto.

The flange 20 is provided at a lengthwise end portion of the photoreceptor drum 10. The flange 20 may be provided to be separable from the photoreceptor drum 10, or may be formed integrally with the photoreceptor drum 10. The flange 20 may be formed of a resin material such as polycarbonate, polyacetal, polyamide or polybutylene terephthalate or a mixture material of these resin materials. However, the materials of the flange 20 are not limited thereto.

The flange 20 has an end surface 22. The end surface 22 in the present example is a surface vertical to the lengthwise direction of the photoreceptor drum 10. In the end surface 22, a through hole is formed at a position to overlap the insertion hole 12 of the photoreceptor drum 10, and the shaft 208 passes through the through hole.

A first protruding portion 30 that protrudes from the end surface 22 of the flange 20 in the lengthwise direction of the photoreceptor drum 10 is provided at the end surface 22. The first protruding portion 30 is formed around the shaft 208. A first opening 32 is provided at the first protruding portion 30. The first opening 32 is provided to penetrate the first protruding portion 30.

A coupling pin that couples the shaft 208 and the flange 20 is inserted into the first opening 32. As one example, a through hole through which a coupling pin can be inserted is formed in the side surface of the shaft 208. The coupling pin may be inserted to the first opening 32 and the through hole of the shaft 208.

Figure 3:
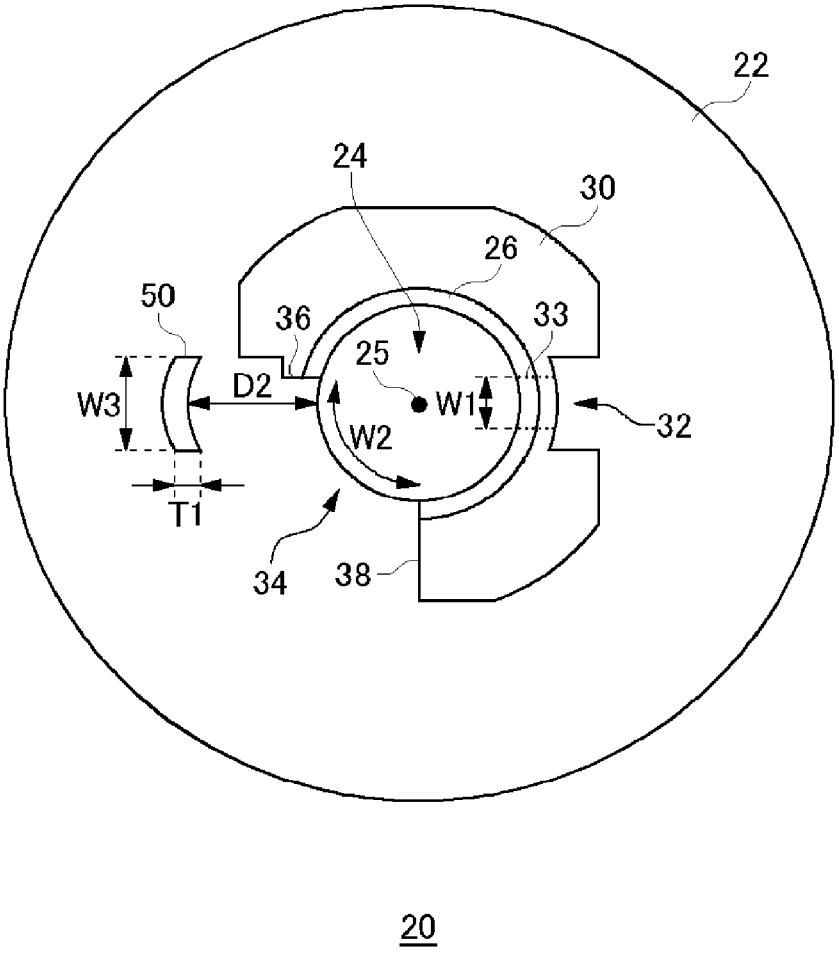
FIG. 3 is a plan showing an end surface 22 of a flange 20.

FIG. 3 is a plan showing the end surface 22 of the flange 20. A through hole 24 through which the shaft 208 passes is formed in the end surface 22. Also, the first protruding portion 30 and a second protruding portion 50 that protrude from the end surface 22 in the lengthwise direction of the photoreceptor drum 10 are provided around the through hole 24 in the end surface 22. A position around the through hole 24 refers to a position which is on the end surface 22 and not overlapping the through hole 24.

The first protruding portion 30 of the present example is formed adjacent to the edge of the through hole 24. In a region on the through hole 24 side on the upper surface of the first protruding portion 30, a tapered portion 26 may be provided to facilitate insertion of the shaft 208. The first protruding portion 30 of the present example is formed adjacent to a partial region of the edge of the through hole 24, and is not formed in the remaining region.

The first opening 32 of the first protruding portion 30 is provided at a position facing the through hole 24. That is, the first opening 32 is arranged such that a rod-like coupling pin inserted into the first opening 32 passes through a region overlapping the through hole 24. The first opening 32 in the present example is a through hole having a diameter which is approximately the same as the diameter of the coupling pin. FIG. 3 shows, with broken lines, the first opening 32 formed inside the first protruding portion 30. The first opening 32 is preferably formed toward a region overlapping a center 25 of the through hole 24 so that the inserted coupling pin passes through the region overlapping the center 25.

Also, at least a lengthwise partial region of the coupling pin is preferably elastic in the diameter direction. At least a lengthwise partial region of the coupling pin may have a hollow tubular shape. Also, a square pin may be used as the coupling pin instead of a round pin. If a square pin is used, the first opening 32 may be a through hole having a cross-section into which the square pin can be inserted.

The second protruding portion 50 is provided, on the end surface 22, at a position opposite to the first opening 32 across the center 25 of the through hole 24. That is, the second protruding portion 50 is provided at a position to abut on an end portion of a rod-like coupling pin inserted into the through hole 24. The first protruding portion 30 and the second protruding portion 50 may be formed of a material which is the same as a plate-like portion having the end surface 22, and integrally with the plate-like portion.

In order to improve the workability for insertion and drawing of the coupling pin into a through hole or the like, the coupling pin is longer than the total length of the through holes provided at the first opening 32 and the shaft 208. That is, at least part of the coupling pin protrudes from the first protruding portion 30 and the shaft 208. At this time, if the length of a portion of the coupling pin protruding from the first protruding portion 30 or the length of a portion of the shaft 208 protruding from the through holes increases, the possibility of the coupling pin interfering with other members along with rotation of the shaft 208 increases.

In contrast, by providing the second protruding portion 50, the coupling pin inserted from the first opening 32 abuts on the second protruding portion 50, and the insertion depth of the coupling pin can be regulated accurately. For this reason, the influence of the shaft 208 on rotation can be reduced.

In the present example, a distance D2 on the end surface 22 between the second protruding portion 50 and the through hole 24 is longer than the distance between the first protruding portion 30 and the through hole 24. Here, the distance between each protruding portion and the through hole 24 refers to the shortest distance between an end portion of the protruding portion and an edge portion of the through hole 24. In the present example, because the first protruding portion 30 is provided adjacent to the edge of the through hole 24, the distance between the first protruding portion 30 and the through hole 24 is 0. The distance D2 may be longer than the distance between an outer circumferential portion of the first opening 32 facing the through hole 24 and the through hole 24, and furthermore, may be longer than the distance between an end portion of a side surface 36 facing the through hole 24 and the through hole 24.

The second protruding portion 50 preferably has a thickness T1 on a surface parallel with the end surface 22 which is smaller than a length W3. The thickness T1 refers to a thickness in the direction in which the coupling pin is inserted into the first opening 32 and the through hole of the shaft 208. The length W3 refers to a length in the direction vertical to the thickness direction. By forming the second protruding portion 50 as a thin portion, the possibility of the second protruding portion 50 interfering with other members at the time of rotation of the shaft 208 can be reduced.

Also, the length W3 of the second protruding portion 50 may be longer than a width W1 of the first opening 32. That is, the length W3 of the second protruding portion 50 may be longer than the width of the coupling pin. Thereby, the depth position of the coupling pin can be regulated even if variation has occurred to the position at which the second protruding portion 50 or the like is provided. The length W3 of the second protruding portion 50 may be 1.2-fold or 1.5-fold of the width W1 of the first opening 32, or longer.

At least part of the shape of the second protruding portion 50 as seen from the direction vertical to the end surface 22 preferably has an arc shape. The second protruding portion 50 of the present example has an arc shape protruding toward the outside of the end surface 22. Thereby, the strength of the second protruding portion 50 formed as a thin portion can be improved.

Also, the curvature of the second protruding portion 50 may be larger than the curvature of the first protruding portion 30. That is, the second protruding portion 50 is more curved than the first protruding portion 30 is. Thereby, the strength of the second protruding portion 50 can be improved. The curvature of the first protruding portion 30 may be a curvature obtained by approximating the external form of the first protruding portion 30 on the end surface 22 with the use of a circle. Also, the second protruding portion 50 may have a curvature larger than a circle whose radius is the distance from the center 25 of the through hole 24 to the second protruding portion 50.

Also, the first protruding portion 30 of the present example has a second opening 34 at a position opposite to the first opening 32 across the center 25 of the through hole 24 on the end surface 22. An opening width W2 of the second opening 34 on the end surface 22 is larger than the opening width W1 of the first opening 32. The opening width of each opening in the present example is a width along the circumference of the through hole 24. The opening width W2 may be two-fold or three-fold of the opening width W1, or larger. In the present example, the opening width W2 is formed along ¼ or more of the circumference of the through hole 24.

The first opening 32 and the second opening 34 may be tunnel-like through holes whose circumferences are surrounded by the first protruding portion 30, and may be open spaces not provided with the first protruding portion 30 in the up-down direction. In the example shown in FIG. 3, the first opening 32 is a through hole, and the second opening 34 is an open space sandwiched, in the circumference direction of the through hole 24, by the side surface 36 and a side surface 38 of the first protruding portion 30. The side surface 36 and side surface 38 of the first protruding portion 30 function as inner walls of the second opening 34. In the present example, the first protruding portion 30 is not provided above and below the second opening 34 in the direction vertical to the end surface 22.

In other examples, the second opening 34 may be a through hole having a diameter larger than that of the first opening 32. Also, the first opening 32 may be an open space not provided with the first protruding portion 30 in the up-down direction.

By making the width of the second opening 34 larger than the width of the first opening 32, alignment of the second opening 34 and the through hole of the shaft 208 at the time of inserting the coupling pin is facilitated. Thereby, the work of incorporating the photoreceptor device 100 into the print cartridge 200 or the like is facilitated.

Also, the first protruding portion 30 of the present example is formed such that the thickness of a portion at which the first opening 32 is provided is smaller than the thicknesses of the other portions. For example, the first protruding portion 30 has a cut-out portion having a thickness smaller than those of the other portions, and the first opening 32 is formed in the cut-put portion. Thereby, insertion of the coupling pin 210 can be facilitated while maintaining the strength of the first protruding portion 30.

Figure 4:
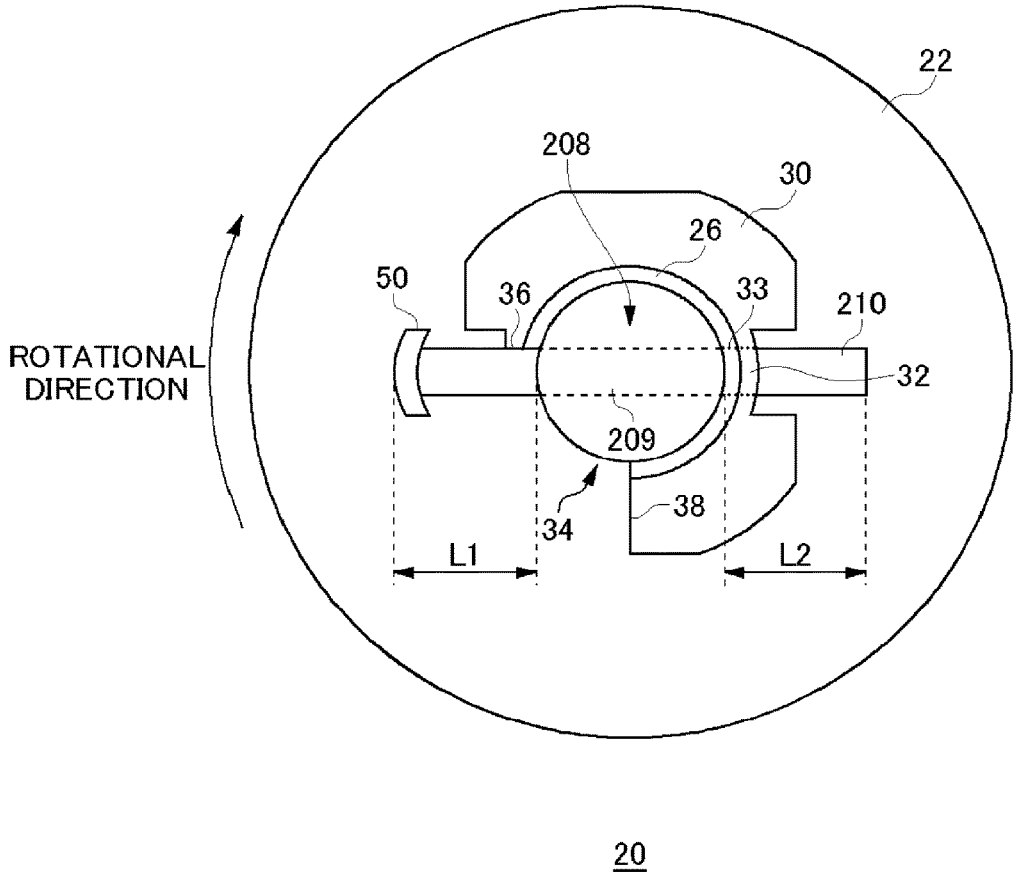
FIG. 4 is a plan of the end surface 22 of the flange 20 in a state where a shaft 208 and a coupling pin 210 are inserted.

FIG. 4 is a plan of the end surface 22 of the flange 20 in a state where the shaft 208 and the coupling pin 210 are inserted. The coupling pin 210 is inserted into the first opening 32 of the first protruding portion 30 and the through hole 209 of the shaft 208, and its end portion abuts on the second protruding portion 50.

The second opening 34, at part of inner walls protruding from the end surface 22 of the flange 20 (the side surface 36 and side surface 38 of the first protruding portion 30 in the present example), has a contact surface (the side surface 36 in the present example) that contacts the coupling pin 210 if the rod-like coupling pin 210 is inserted into the first opening 32 and the second opening 34. Also, among the inner walls of the second opening 34, a surface (the side surface 38 in the present example) opposite to the contact surface (side surface 36) does not contact the coupling pin 210.

The side surface 36 is preferably provided so as to be arranged on the same straight line with the inner wall 33 of the first opening 32. However, the side surface 36 only has to be provided to contact the coupling pin 210 that has passed through the first opening 32, and if the side wall of the coupling pin 210 has a non-linear shape, the side surface 36 may not be arranged on the same straight line with the inner wall 33 of the first opening 32.

The photoreceptor drum 10 rotates in a predetermined rotational direction when performing printing operation. The side surface 36 that contacts the coupling pin 210 is provided downstream of the coupling pin 210 in the rotational direction. With such an arrangement, a driving force from the shaft 208 at the time of printing operation can be conveyed not only to the first opening 32, but also to the photoreceptor drum 10 through the side surface 36.

The side surface 36 may have a shape which is the same as the shape of the side wall of the coupling pin 210. In this case, the side surface 36 can be in surface contact with the coupling pin 210. Also, the side surface 36 may be a vertical surface. In this case, if the coupling pin 210 has a columnar shape, the side surface 36 is in line contact with the coupling pin 210. However, the shape of the side surface 36 is not limited to these shapes. The side surface 36 may be any shape as long as it can contact the coupling pin 210.

The side surface 38 may have a shape which is the same as the shape of the side surface 36, or have a different shape. In the present example, the length of the side surface 36 in the radial direction of the shaft 208 is shorter than the length of the side surface 38. By making the side surface 36 short, insertion of the coupling pin 210 can be facilitated. The length of the side surface 36 may be the same as the length of the first opening 32 in the radial direction of the shaft 208. In this case, a driving force conveyed from the coupling pin 210 can be made uniform in the first opening 32 and the second opening 34.

Also, the second protruding portion 50 is preferably arranged such that a length L2 of a portion of the coupling pin 210 that protrudes from the shaft 208 on the first opening 32 side becomes equal to a total length L1 of the length of a portion of the coupling pin 210 that protrudes from the shaft 208 and the thickness of the second protruding portion 50 on the second opening 34 side. Thereby, the possibility of the coupling pin 210 and the second protruding portion 50 contacting other members at the time of rotation of the photoreceptor drum 10 can be reduced. The length of a portion of the first protruding portion 30 that protrudes from the shaft 208 in the radial direction of the shaft 208 is preferably smaller than any of the above-mentioned lengths L1 and L2.

Figure 5:
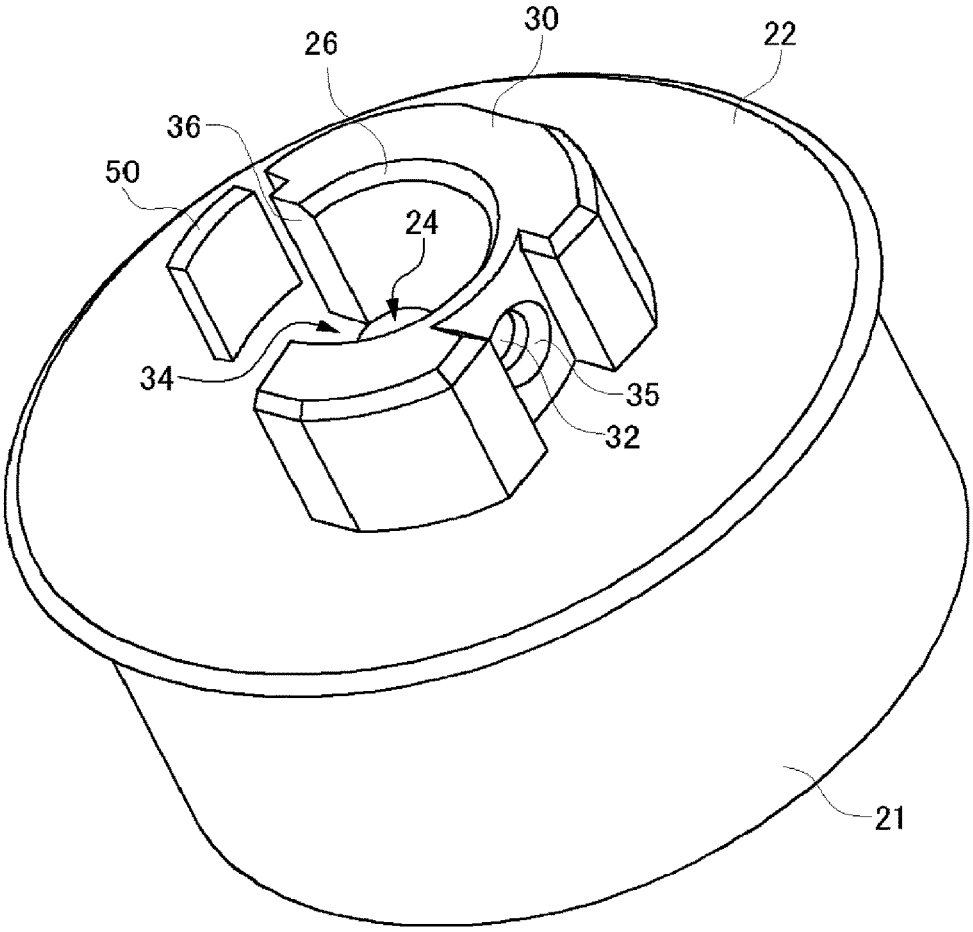
FIG. 5 is a perspective view showing a summary of the flange 20.

FIG. 5 is a perspective view showing a summary of the flange 20. The flange 20 of the present example has the first protruding portion 30, the second protruding portion 50 and a fitting portion 21. The fitting portion 21 is formed to protrude from the surface opposite to the end surface 22. The fitting portion 21 has a shape capable of fitting with the photoreceptor drum 10. An end portion of the photoreceptor drum 10 has a tubular shape into which the fitting portion 21 can be inserted. By fitting the fitting portion 21 to the end portion of the photoreceptor drum 10, the flange 20 is fixed to the photoreceptor drum 10. The fitting portion 21 fixes the flange 20 to the photoreceptor drum 10 so that if the shaft 208 is rotated, the flange 20 does not rotate relative to the photoreceptor drum 10.

In the flange 20 of the present example, the first opening 32 is a through hole, and the second opening 34 is an open space. The first opening 32 of the present example has, at its end portion which is opposite to the through hole 24, a tapered portion 35. The diameter of the tapered portion 35 increases as the distance from the through hole 24 increases. Thereby, the coupling pin 210 can be inserted easily from the first opening 32 side.

Second Implementation Example

Figure 6:
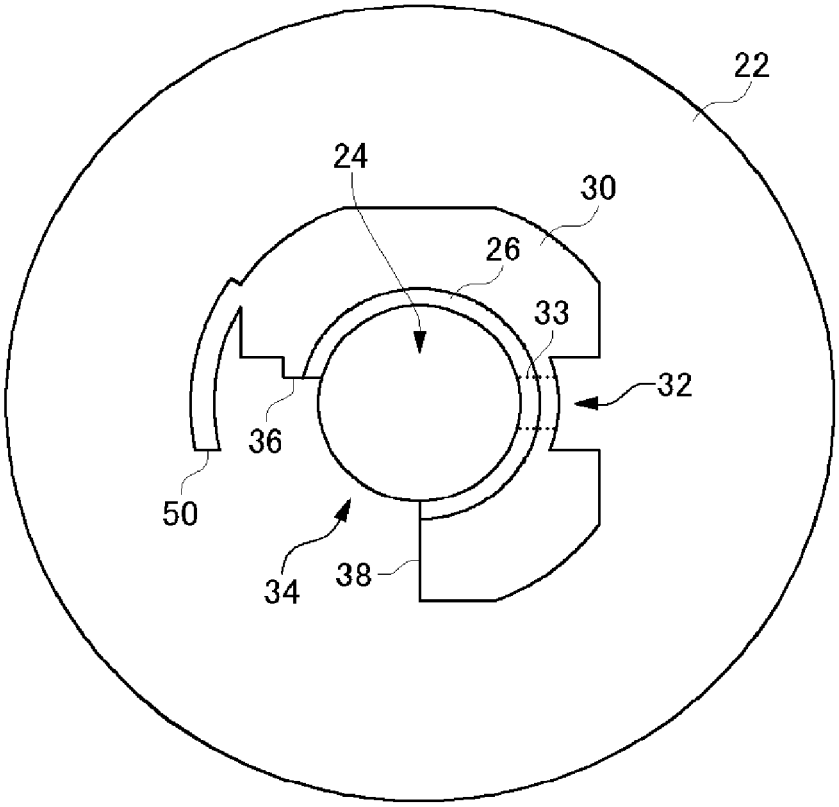
FIG. 6 is a plan showing the end surface 22 of the flange 20 according to a second implementation example.

FIG. 6 is a plan showing the end surface 22 of the flange 20 according to a second implementation example. The flange 20 of the present example has the first protruding portion 30 and the second protruding portion 50 that are formed integrally. In other respects, the structure is similar to that of the flange 20 according to the first implementation example. That the first protruding portion 30 and the second protruding portion 50 are formed integrally means that the first protruding portion 30 and the second protruding portion 50 are connected at connection portions that protrude from the end surface 22.

The second protruding portion 50 of the present example is connected with the first protruding portion 30 on the side surface 36 side. In other examples, the second protruding portion 50 may be connected to the first protruding portion 30 on the side surface 38 side, or may be connected to the first protruding portion 30 on both the side surface 36 side and the side surface 38 side.

In the direction vertical to the end surface 22, the connected portions may have the same height as the first protruding portion 30, and may have the same height as the second protruding portion 50. Also, the connected portions may be formed to be lower than the first protruding portion 30, and formed to be lower than the second protruding portion 50. Also, the connected portions may have a thickness which is the same as that of the second protruding portion 50. By forming the second protruding portion 50 and the first protruding portion 30 integrally, the strength of the second protruding portion 50 can be improved.

Third Implementation Example

Figure 7:
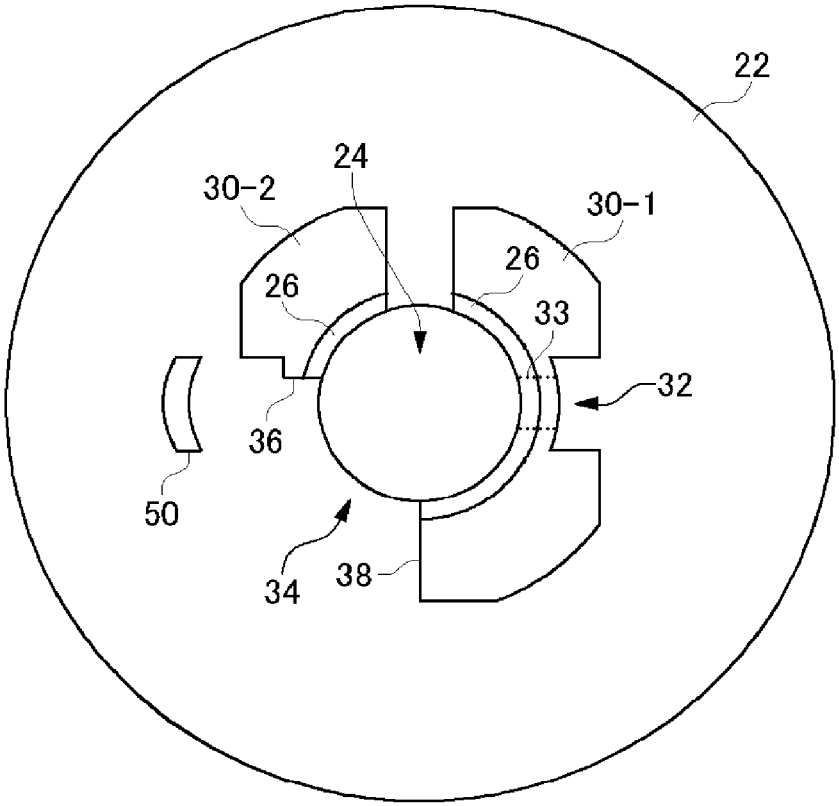
FIG. 7 is a plan showing the end surface 22 of the flange 20 according to a third implementation example.

FIG. 7 is a plan showing the end surface 22 of the flange 20 according to a third implementation example. In the flange 20 of the present example, the first protruding portion 30 is separated into two. That the first protruding portion 30 is separated into two means that the end surface 22 is exposed between the two first protruding portions 30. The first opening 32 is formed in one first protruding portion 30-1, and the side surface 36 to contact the coupling pin 210 is formed in the other first protruding portion 30-2.

Even with such a structure, effects similar to those attained in the first implementation example can be attained. At least one of the first protruding portion 30-1 and the first protruding portion 30-2 may be formed integrally with the second protruding portion 50.

Fourth Implementation Example

Figure 8:
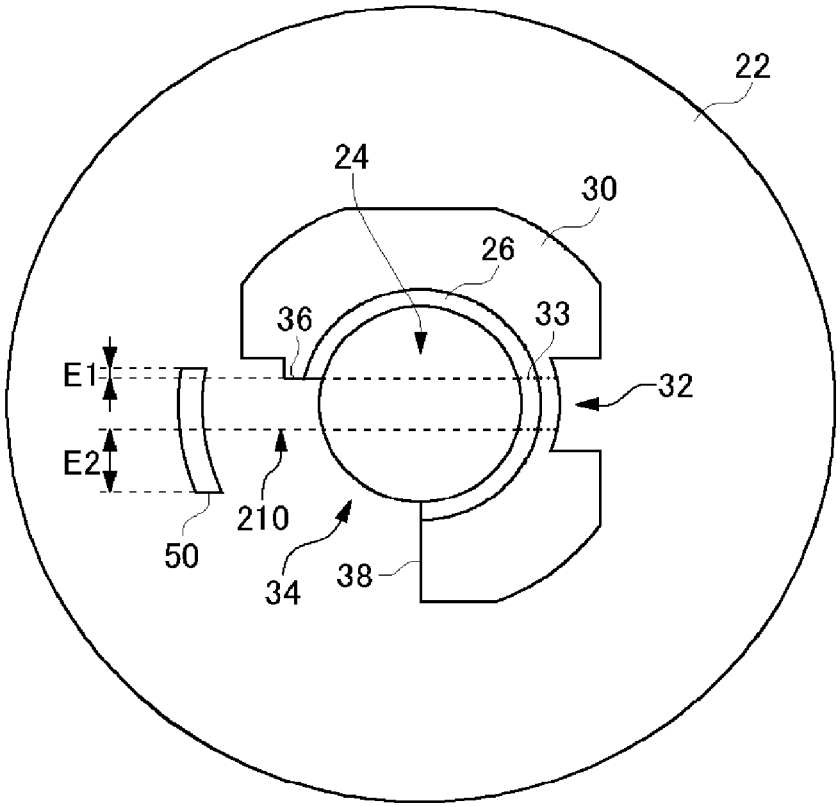
FIG. 8 is a plan showing the end surface 22 of the flange 20 according to a fourth implementation example.

FIG. 8 is a plan showing the end surface 22 of the flange 20 according to a fourth implementation example. The flange 20 of the present example is different from the flange 20 according to the first to third implementation examples in the position of the second protruding portion 50. In other respects, the structure is similar to that of the flange 20 according to any of the first to third implementation examples.

The second protruding portion 50 of the present example is provided at a position that is closer to the side surface 38 side, relative to imaginary extension lines of the first opening 32 along the coupling pin 210. FIG. 8 shows, with broken lines, imaginary extension lines of the first opening 32 (that is, positions where the coupling pin 210 passes). In the present example, the length of a portion of the second protruding portion 50 that protrudes from the imaginary position of the extended first opening 32 to the side surface 36 side is a length E1, and the length of a portion that protrudes to the side surface 38 side is E2. The second protruding portion 50 of the present example is arranged such that E1 is shorter than E2.

Because the side surface 36 contacts the coupling pin 210, the coupling pin 210 relatively easily causes positional misalignment toward the side surface 38 side. In contrast, by arranging the second protruding portion 50 as shown in FIG. 8, even if positional misalignment occurred to the coupling pin 210, the state where the second protruding portion 50 abuts on the coupling pin 210 can be maintained.

Fifth Implementation Example

Figure 9:
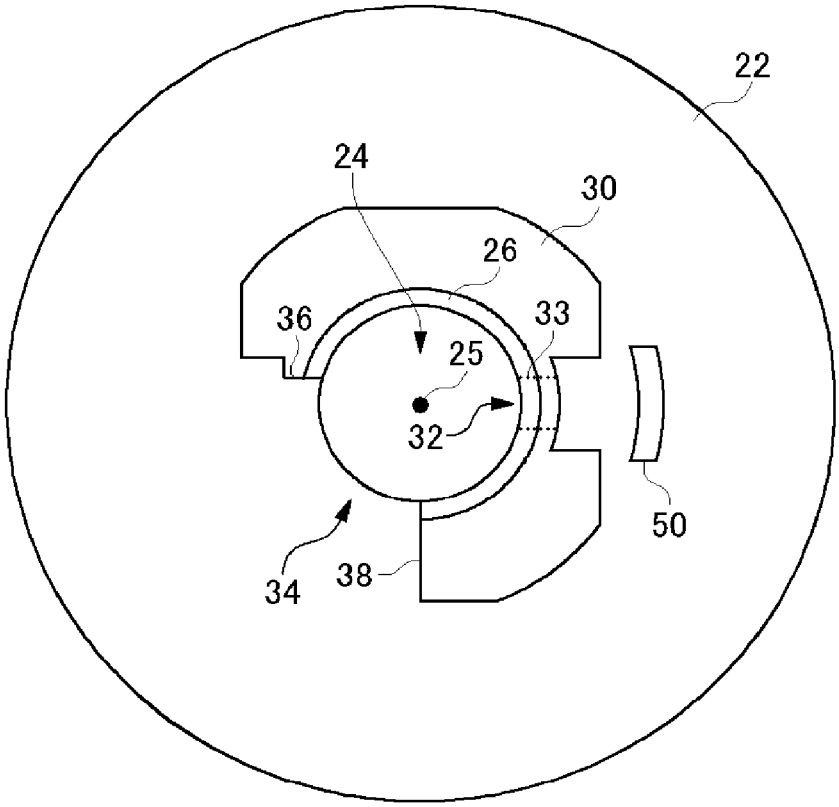
FIG. 9 is a plan showing the end surface 22 of the flange 20 according to a fifth implementation example.

FIG. 9 is a plan showing the end surface 22 of the flange 20 according to a fifth implementation example. The flange 20 of the present example is different from the flange 20 according to the first to fourth implementation examples in the position of the second protruding portion 50. In other respects, the structure is similar to that of the flange 20 according to any of the first to fourth implementation examples.

The second protruding portion 50 of the present example is provided at a position opposite to the second opening 34 across the center 25 of the through hole 24. More specifically, the second protruding portion 50 is provided at a position outside the first opening 32 and facing the first opening 32. That the second protruding portion 50 is provided outside the first opening 32 means that the distance from the center 25 of the through hole 24 to the second protruding portion 50 is longer than the distance from the center 25 to the first opening 32.

Even with such a configuration, the insertion depth of the coupling pin 210 can be regulated accurately. In the fifth implementation example, the coupling pin 210 is inserted from the second opening 34 side. The first opening 32 of the present example may not have the tapered portion 35 shown in FIG. 5. The first opening 32 may have, on the through hole 24 side, a tapered portion having a diameter that increases as the distance from the through hole 24 decreases.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

EXPLANATION OF REFERENCE NUMERALS

10: photoreceptor drum; 12: insertion hole; 20: flange; 21: fitting portion; 22: end surface; 24: through hole; 25: center; 26: tapered portion; 30: first protruding portion; 32: first opening; 33: inner wall; 34: second opening; 35: tapered portion; 36: side surface; 38: side surface; 50: second protruding portion; 100: photoreceptor device; 200: print cartridge; 202: charging control unit; 204: toner supply unit; 206: toner eliminating unit; 208: shaft; 209: through hole; 210: coupling pin

What is claimed is:

1. A photoreceptor device comprising:

a photoreceptor drum having an insertion hole formed along a lengthwise direction; and a flange that is provided at a lengthwise end portion of the photoreceptor drum and has a through hole formed thereon at a position to overlap the insertion hole, wherein the flange has a first protruding portion and a second protruding portion that: are provided on an end surface at which the through hole is provided and around the through hole; and protrude from the end surface, the first protruding portion has a first opening at a position facing the through hole, and the second protruding portion is provided at a position opposite to the first opening across a center of the through hole on the end surface, wherein a distance on the end surface between the second protruding portion and the through hole is longer than a distance between the first protruding portion and the through hole.

2. The photoreceptor device according to claim 1, wherein the first protruding portion has a second opening that is located at a position opposite to the first opening across the center of the through hole on the end surface, and that has an opening width on the end surface which is larger than that of the first opening.

3. The photoreceptor device according to claim 2, wherein the second opening has a contact surface that is located at part of an inner wall of the first protruding portion protruding from the end surface of the flange and that contacts a rod-like coupling pin when the coupling pin is inserted into the first opening and the second opening, and a surface of the inner wall that is opposite to the contact surface does not contact the coupling pin.

4. The photoreceptor device according to claim 3, wherein when performing printing operation, the photoreceptor drum rotates in a predetermined rotational direction, and the contact surface of the second opening is provided downstream of the coupling pin in the rotational direction.

5. The photoreceptor device according to claim 1, wherein the second protruding portion has an arc shape on a surface that is parallel with the end surface of the flange.

6. The photoreceptor device according to claim 5, wherein a curvature of the second protruding portion is larger than a curvature of the first protruding portion.

7. The photoreceptor device according to claim 1, wherein a thickness of the second protruding portion is smaller than a length of the second protruding portion.

8. The photoreceptor device according to claim 1, wherein the first protruding portion and the second protruding portion are formed integrally.

9. The photoreceptor device according to claim 1, wherein a width of the second protruding portion is larger than a width of the first opening on the end surface.

10. The photoreceptor device according to claim 1, wherein the first opening is provided with a tapered portion at an end portion thereof which is opposite to the through hole.

* * * * *